US009464254B2

(12) United States Patent
Dodd

(10) Patent No.: US 9,464,254 B2
(45) Date of Patent: Oct. 11, 2016

(54) MARINE ENGINE LUBRICATION

(71) Applicant: James C. Dodd, Didcot (GB)

(72) Inventor: James C. Dodd, Didcot (GB)

(73) Assignee: INFINEUM INTERNATIONAL LIMITED (GB)

( * ) Notice: Subject to any disclaimer, the term of this patent is extended or adjusted under 35 U.S.C. 154(b) by 793 days.

(21) Appl. No.: 13/911,113

(22) Filed: Jun. 6, 2013

(65) Prior Publication Data

US 2014/0360450 A1 Dec. 11, 2014

(30) Foreign Application Priority Data

Jun. 7, 2012 (EP) ..... 12171193

(51) Int. Cl.

| | |
|---|---|
| ***F02B 47/00*** | (2006.01) |
| ***C10M 129/54*** | (2006.01) |
| ***C10M 125/22*** | (2006.01) |
| ***C10M 129/50*** | (2006.01) |
| ***C10M 159/20*** | (2006.01) |

(52) U.S. Cl.

CPC ..... *C10M 129/54* (2013.01); *C10M 125/22* (2013.01); *C10M 129/50* (2013.01); *C10M 159/20* (2013.01); *C10M 2201/084* (2013.01); *C10M 2207/028* (2013.01); *C10M 2207/141* (2013.01); *C10M 2207/144* (2013.01); *C10M 2207/262* (2013.01); *C10M 2219/046* (2013.01); *C10N 2210/02* (2013.01); *C10N 2230/06* (2013.01); *C10N 2230/08* (2013.01); *C10N 2230/10* (2013.01); *C10N 2240/102* (2013.01)

(58) Field of Classification Search

CPC ..... C10M 129/54; C10M 159/20; C10M 125/22; C10M 129/50; C10M 2207/028; C10M 2219/046; C10M 2207/262; C10M 2207/141; C10N 2240/102; C10N 2210/02; C10N 2230/08; C10N 2230/06; C10N 2230/10

USPC ..... 123/1 A

See application file for complete search history.

(56) References Cited

U.S. PATENT DOCUMENTS

| | | | | |
|---|---|---|---|---|
| 5,711,270 | A | 1/1998 | Pedersen | |
| 6,528,459 | B1 * | 3/2003 | Roman | C10M 163/00 508/192 |
| 2011/0297122 | A1 * | 12/2011 | Bardasz | C10M 133/56 123/299 |

FOREIGN PATENT DOCUMENTS

| | | | |
|---|---|---|---|
| EP | 1728849 | A1 | 12/2006 |
| WO | WO-97/46647 | A1 | 2/1997 |
| WO | WO-2011/051261 | A1 | 5/2011 |

* cited by examiner

*Primary Examiner* — Hung Q Nguyen

(57) ABSTRACT

A two-stroke, cross-head, slow-speed, compression-ignited marine engine is operated by (i) fuelling it with a diesel fuel, as a pilot fuel, and with a low sulphur fuel, as a main fuel; and (ii) lubricating the engine cylinder(s) with a lubricant having a BN of 20 or less and having a detergent additive system comprising at least two different metal detergents each having one surfactant group selected from phenate, salicylate and sulphonate, or one or more complex metal detergents containing two or more different surfactant soap groups selected from phenate, salicylate and sulphonate.

11 Claims, No Drawings

MARINE ENGINE LUBRICATION

FIELD OF THE INVENTION

The invention relates to a method of operating a two-stroke, cross-head, slow speed, compression-ignited (diesel) marine engine that is fuelled with liquid natural gas and, in particular, to cylinder lubrication of the engine during operation.

BACKGROUND OF THE INVENTION

In a marine diesel cross-head engine, the cylinder liner and the crankcase are lubricated separately using a cylinder oil and a system oil respectively. The cylinder oil, often referred to as a marine diesel lubricant (or MDCL), lubricates the inner walls of the engine cylinder and the piston ring pack, and controls corrosive and mechanical wear.

Such engines are usually fuelled by heavy fuel oil or marine distillate fuel. These fuels have a high sulphur and heavy metal content, as well as being of high viscosity and being difficult to handle. For example, a heavy fuel oil may have sulphur levels ranging from 50 ppm to more than 4.0% by mass. For engines operating with these fuels, the MDCL has to be designed to provide base to neutralise the acids produced as a result of combustion of the sulphur-containing fuel. Typical MDCL's may have a total base number of 70-100 mg KOH/g (ASTM D 2896-98).

More recently, efforts are being made to reduce fuel sulphur levels in marine fuels in order to reduce the adverse environmental impact of large marine engines.

This invention is concerned with using low sulphur fuels such as liquid natural gas (LNG) as the fuel. Since LNG predominantly consists of methane, with the balance made up of other hydrocarbons, the MDCL does not require excess base to neutralise acids. It is, however, still required to provide wear protection and cleanliness to the cylinder liner and piston area of the engine. Low sulphur fuels generally have a sulphur level of 0.5% or less.

WO 2011/051261-A ('261) generally describes lubricants having a TBN of at least 10 mg KOH/g for improving deposit formation in marine diesel engines. '261 exemplifies formulations of marine cylinder oils for use in marine diesel engines. However, all examples are conducted at TBN's in excess of 20 and the specification makes no mention of LNG-fuelled engines. '261 states that its best examples are Examples 5 and 6, where the lubricant comprises a low BN Ca sulphonate and a high BN Ca phenate.

A problem in the art is to provide MDCL's for use in a LNG- and similarly fuelled marine cross-head engine where the MDCL has a low base content, but yet is still capable of providing wear protection and cleanliness properties.

SUMMARY OF THE INVENTION

The above problem is met according to the invention by providing an MDCL of TBN less than 20 and having a defined detergent system constitution.

Thus, the present invention provides a method of operating a two-stroke, cross-head slow-speed compression-ignited engine comprising (i) fuelling the engine with a diesel fuel, as a pilot fuel, and with a low sulphur fuel such as liquefied natural gas, as a main fuel; and (ii) lubricating the cylinder(s) of the engine with a cylinder lubricant having a base number (BN) of 20 or less and having a detergent additive system comprising at least two different metal detergents each having one surfactant group selected from phenate, salicylate and sulphonate, or one or more complex metal detergents containing two or more different surfactant soap groups selected from phenate, salicylate and sulphonate.

A two-stroke, cross-head slow-speed compression-ignited engine usually has a speed of below 200 rpm, such as, for example, 10-200 rpm or 60-200 rpm.

In this specification, the following words and expressions, if and when used, have the meanings ascribed below:

"active ingredients" or "(a.i.)" refers to additive material that is not diluent or solvent;

"basicity index (or BI)" in the molar ratio of total base to total soap in an overbased detergent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 mass % or more of a composition;

"minor amount" means less than 50 mass % of a composition;

"TBN" means total base number as measured by ASTM D2896.

Furthermore in this specification, if and when used:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be disclosed in more detail below.

Cylinder Lubricant ("MDCL")

As stated the MDCL has a BN of 20 or less. Preferably the BN is 15 or less such as in the range from 5 to 15 or 10 to 15.

The MDCL may comprise 10-35, preferably 13-30, most preferably 16-24, mass % of a concentrate or additive package, the remainder being oil of lubricating viscosity. It preferably includes at least 50, more preferably at least 60, even more preferably at least 70, mass % of oil of lubricating viscosity based on the total mass of MDCL.

The additive package includes the detergent system defined under the SUMMARY OF THE INVENTION heading above. It may also include one or more dispersants, one or more anti-wear agents such as zinc compounds and boron compounds, and one or more pour point depressants.

Oil of Lubricating Viscosity

This may be any oil suitable for lubricating the cylinder(s) of a marine diesel cross-head engine.

It may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified, for example by esterification, etherification, constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of polyethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment, are unrefined oils. Refined oils are similar to unrefined oils except that the oil is further treated in one or more purification steps to improve one or more properties. Many such purification techniques, such as distillation, solvent extraction, acid or base extraction, filtration and percolation, are known to those skilled in the art. Re-refined oils are obtained by processes similar to those used to provide refined oils but that begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes base stocks into various groups.

The oil of lubricating viscosity in the lubricant used in this invention comprises 50 mass % or more of the lubricant. Preferably, it comprises 60, such as 70, 80 or 90, mass % or more of the lubricant.

Detergent Additive System

As stated, the detergent additive system comprises (A) at least two different metal detergents each having one surfactant group, selected from phenate, salicylate and sulphonate; or (B) at least one complex metal detergent containing two or more different surfactant soap groups selected from phenate, salicylate and sulphonate.

The metal may, for example, be an alkaline earth metal, preferably calcium.

In (A), the difference between the detergents may be in respect of the surfactant soap groups, or in respect of the TBN's (or basicity indices, BI's) of the detergents, or both.

In (B), one or more metal detergents having one surfactant group may be present with the complex detergent(s). By "complex" (or hybrid) detergent is meant a detergent prepared from a mixture of more than one metal surfactant, such as a calcium alkyl phenate and a calcium alkyl salicylate. Such a complex detergent is a hybrid material in which the surfactant groups, for example phenate and salicylate, are incorporated during the overbasing process. Examples of complex detergents are described in the art (see, for example, WO 97/46643, WO 97/46644, WO 97/46645, WO 97/46646 and WO 97/46647).

As an example of (B), there may be mentioned (i) a complex metal phenate/sulphonate detergent or a complex metal phenate, salicylate and sulphonate detergent and, optionally, (ii) one or more individual phenate, sulphonate or salicylate detergents.

Surfactants for the surfactant system of the metal detergents contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility. Advantageously the alkyl groups include from 5 to 100, preferably from 9 to 40, carbon atoms. Where there is more than one alkyl group, the average number of carbon atoms in all of the alkyl groups is preferably at least 9 to ensure adequate oil-solubility.

The detergents may be non-sulphurized or sulphurized, and may be chemically modified and/or contain additional substituents. Suitable sulphurizing processes are well known to those skilled in the art.

The detergents may be borated, using borating processes well known to those skilled in the art.

The detergents in the detergent system may be low base number (LBN), medium base number (MBN) or high base number (HBN), where the meanings of those numbers are set out in the table below.

| | Phenate | Salicylate | Sulphonate |
|---|---|---|---|
| LBN | | <100 | <100 |
| MBN | >100 and <200 | >100 and <250 | >100 and <400 |
| HBN | >200 | >250 | >400 |

The complex detergents generally have BN's in the range 250 to 450, preferably 300 to 420, mg KOH/g.

As examples of preferred combinations of the metal detergents there may be mentioned Phenate plus Sulphonate, Phenate plus Sulphonate plus Salicylate, Phenate plus Salicylate, or combinations and variations thereof.

As examples of preferred proportions and ratios of the metal detergents in the detergent system there may be mentioned the range 0.25 to 1 to 0.95 to 1.

Operation of Engine

The marine two stroke engine is operated by igniting a minor charge of liquid hydrocarbon fuel such as diesel, marine distillate fuel (MDO), marine gas oil (MGO), heavy fuel oil (HFO). A major charge of a low sulphur content fuel (e.g. having less than 0.1 mass % of atoms of sulphur) is then applied. The low sulphur content fuel may, for example be a gaseous fuel such as liquefied natural gas (LNG) or compressed natural gas (CNG), or a liquid fuel such as fuel derived from bio matter, e.g. palm oil.

EXAMPLES

The following examples illustrate the invention.

A set of MDCL's was formulated, each having a BN of 10 and containing a Zn/B part package (formulated to deliver approx. 100 ppm B, 0.2% Zn and approximately 470 ppm N). The members of the set comprised a base oil and detergent system of the following calcium detergents, identified by the indicated codes.

Codes

LBN Sul: Ca Sulfonate of BI 0.4
MBN Sul: Ca Sulfonate of BI 12.7
HBN Sul: Ca Sulfonate of BI 22
MBN Phe: Ca Phenate of BI 1.8
HBN Phe: Ca Phenate of BI 2.9
LBN Sal: Ca Salicylate of BI 1.35
MBN Sal: Ca Salicylate of BI 3.0
HBN Sal: Ca Salicylate of BI 7.8
HBN Complex (3): Ca Sulfonate/Phenate/Salicylate of BI 10
HBN Complex (2): Ca Sulfonate/Phenate of BI 18
LBN, MBN and HBN represents low, medium and high BN respectively.

Testing

Samples of each the MDCL's were tested in the Panel Coker High Temperature Detergency Test ("PC"), the High Frequency Reciprocating Rig (HT HFRR) Test and the Komatsu Hot Test (for High Temperature Resistance, 330° C., 16 hours) (KHTT).

The test procedures are described as follows.

Panel Coker

The Panel Coker Test involves splashing the MDCL onto a heated test panel to see if it degrades and leaves any deposits that might affect engine performance. The test uses a panel coker tester (model PK-S) supplied by Yoshida Kagaku Kikai Co, Osaka, Japan. The test starts by heating the MDCL to a temperature of 100° C. through an oil bath. A test panel made of aluminium alloy, which has been cleaned using acetone and heptane and weighed, is placed above the MDCL and heated to 320° C. using an electric heating element. When both temperatures have stabilised, a splasher splashes the MDCL onto the heated test panel in a discontinuous mode: the splasher splashes the MDCL for 15 seconds and then stops for 45 seconds. The discontinuous splashing takes place over 1 hour, after which the test is stopped, everything is allowed to cool down, and then the aluminium test panel is weighed and rated visually. The difference in weight of the aluminium test panel before and after the test, expressed in mg, is the weight of deposits. This test is used for simulating the ability of MDCL to prevent deposit formation on pistons. The panel is also rated by an electronic optical rater using a Video-Cotateur from ADDS, for discolouration caused by MDCL deposits. The higher the merit rating, the cleaner the panel.

HT HFRR

The HFRR or High Frequency Reciprocating Rig Test is a computer-controlled reciprocating oscillatory friction and wear test system for the wear testing of lubricants under boundary lubrication conditions. An electromagnetic vibrator oscillates a steel ball over a small amplitude while pressing it with a load of 10N against a stationary steel disc. The lower, fixed disc is heated electrically and is fixed below the MDCL. The temperature is ramped from 80° C. to 380° C. in 15 minutes. The friction coefficient is measured vs. temperature. The friction coefficient decreases with increase in temperature due to the viscosity decrease of the MDCL, until a temperature at which oil film breakdown begins. At this point, the friction coefficient begins to increase again. The temperature at which the friction coefficient is a minimum is measured; the higher this temperature, the better the MDCL is at protecting the cylinder liner against scuffing wear.

KHTT

The Hot Tube Test evaluates the high temperature stability of a lubricant. Oil droplets are pushed up by air inside a heated narrow glass capillary tube and the thin film oxidative stability of the MDCL is measured by the degree of lacquer formation on the glass tube, the resulting colour of the tube being rated on a scale of 0-10. A rating of 0 refers to heavy deposit formation and a rating of 10 means a clean glass tube at the end of the test. The method is described in SAE paper 840262. The level of lacquer formation in the tube reflects the high temperature stability of the MDCL and its tendency during service to form deposits in high temperature areas of the engine.

Results

The results of the tests are set out in the table below.

| | Detergent System | | | | HT HFRR | | | |
|---|---|---|---|---|---|---|---|---|
| Ex | Type | % Ca | BI | KHTT | Min Fn | T of Min Fn | % Fn incr | PC |
| A | HBN Sul | 0.34 | 22 | 244.7 | 0.127 | 299.2 | 73.4 | 20.3 |
| B | MBN Phe | 0.34 | 1.8 | 563.0 | 0.141 | 228.3 | 182.9 | 22.7 |
| C | HBN Phe | 0.33 | 2.9 | 541.3 | 0.127 | 228.3 | 63.1 | 50.1 |
| D | LBN Sal | 0.32 | 1.35 | 0.3 | 0.109 | 248.4 | 184.4 | 13.7 |
| E | MBN Sal | 0.32 | 3.0 | 4.3 | 0.046 | 276.1 | 27.0 | 11.3 |
| F | HBN Sal | 0.32 | 7.8 | 107.6 | 0.072 | 234.6 | 34.2 | 2.7 |
| 1 | HBN Complex (3) | 0.34 | 10 | 30.0 | 0.100 | 283.3 | 239.0 | 28.6 |
| 2 | MBN Phe | 0.31 | 1.8 | 11.3 | 0.138 | 256.7 | 39.6 | 209.1 |
| | LBN Sul | 0.11 | 0.4 | | | | | |
| 3 | LBN Sal | 0.11 | 1.35 | 9.5 | 0.069 | 289.5 | 32.2 | 13.2 |
| | MBN Phe | 0.22 | 1.8 | | | | | |
| 4 | LBN Sal | 0.23 | 1.35 | 3.3 | 0.058 | 298.0 | 70.7 | 13.8 |
| | LBN Sul | 0.34 | 0.4 | | | | | |
| 5 | LBN Sal | 0.11 | 1.35 | 11.6 | 0.089 | — | 32.4 | 9.8 |
| | LBN Sul | 0.11 | 0.4 | | | | | |
| | MBN Phe | 0.19 | 1.8 | | | | | |
| 6 | LBN Sul | 0.09 | 0.4 | 21.5 | 0.103 | 347.6 | 111.9 | 5.9 |
| | HBN Sul | 0.32 | 22 | | | | | |
| 7 | HBN Phe | 0.19 | 2.9 | 8.8 | 0.082 | 354.3 | 96.4 | 30 |
| | MBN Sul | 0.12 | 12.7 | | | | | |
| | LBN Sul | 0.06 | 0.4 | | | | | |
| 8 | LBN Sal | 0.16 | 1.35 | 8.8 | 0.037 | 341.0 | 88.1 | 113.4 |
| | MBN Sul | 0.17 | 12.7 | | | | | |
| 9 | HBN Complex (2) | 0.34 | 18 | 1.1 | 0.103 | 354.5 | 100.9 | 64.2 |
| 10 | MBN Sal | 0.24 | 3.0 | 11.5 | 0.050 | 311.1 | 21.2 | 130.8 |
| | LBN Sul | 0.11 | 0.4 | | | | | |
| | MBN Phe | 0.05 | 1.8 | | | | | |
| 11 | HBN Sal | 0.25 | 7.8 | 1.9 | 0.047 | 316.2 | 81.0 | 50.1 |
| | LBN Sul | 0.04 | 0.4 | | | | | |
| | HBN Phe | 0.07 | 2.9 | | | | | |
| 12 | LBN Sal | 0.14 | 1.35 | 21.6 | 0.043 | 331.4 | 25.6 | 10.3 |
| | Complex (2) | 0.18 | 18 | | | | | |
| 13 | MBN Phe | 0.11 | 1.8 | 5.9 | 0.109 | 371.3 | 3.7 | 36.8 |
| | Complex (3) | 0.18 | 10 | | | | | |

The KHTT results are expressed as mass of deposits forming, a lower value indicating a better performance.

The FIT HFRR results are expressed as:

minimum coefficient of friction ("Min Fn"), a lower value indicating a better performance;

temperature in ° C. of minimum friction ("T of Min Fn"), a higher value indicating a better performance; and % friction increment ("% Fn incr), a lower value indicating a better performance.

The PC results are expressed as mass of deposits formed in g, a lower value indicating a better performance.

The data show that the combination of different detergent types or the use of complex detergents where one or more surfactant types are present give rise to better performance than the use of single detergent alone.

What is claimed is:

1. A method of operating a two-stroke, cross-head slow-speed compression-ignited engine comprising (i) fuelling the engine with a diesel fuel, as a pilot fuel, and with a low sulphur fuel, as a main fuel; and (ii) lubricating the cylinder(s) of the engine with a cylinder lubricant having a base number (BN) of 20 or less and having a detergent additive system comprising at least two different metal detergents each having one surfactant selected from phenate, salicylate and sulphonate, wherein at least one of the metal detergents in the detergent additive system includes phenate as the surfactant, and has a total base number (TBN) as determined by ASTM D 2896-98 of greater than 200 mg KOH/g, and at least one of the metal detergents in the detergent additive system includes sulphonate as the surfactant, and has a total base number (TBN) as determined by ASTM D 2896-98 of greater than 100 mg KOH/g; or one or more complex metal detergents containing two or more different surfactants selected from phenate, salicylate and sulphonate, wherein a least one of said complex metal detergents comprises a complex metal phenate/sulphonate detergent or a complex metal phenate/sulphonate/salicylate detergent, and has a total base number (TBN) as determined by ASTM D 2896-98 of greater than 200 mg KOH/g.

2. A method as claimed in claim 1, wherein the cylinder lubricant also comprises a zinc—and boron-containing anti-wear system.

3. A method as claimed in claim 1, wherein at least one of the metal detergents in the detergent additive system includes salicylate as the surfactant, and has a total base number (TBN) as determined by ASTM D 2896-98 of less than 250 mg KOH/g.

4. A method as claimed in claim 1, wherein the detergent additive system comprises (i) a complex metal phenate/sulphonate detergent or a complex metal phenate/sulphonate/salicylate detergent having a total base number (TBN) as determined by ASTM D 2896-98 of greater than 200 mg KOH/g and, optionally, (ii) one or more individual phenate, sulphonate or salicylate detergents.

5. A method as claimed in claim 1, wherein the metal is calcium.

6. A method as claimed in claim 1, wherein the cylinder lubricant has a base number (BN) of 17 mg KOH/g or less.

7. A method as claimed in claim 1, wherein the fuel includes more than 50% of main fuel and less than 50% of pilot fuel.

8. A method as claimed in claim 7, wherein the fuel includes more than 60%, of main fuel.

9. A method as claimed in claim 8, wherein the fuel includes more than 90% of main fuel.

10. A method as claimed in claim 7, wherein the main fuel is a low sulphur gaseous fuel.

11. A method as claimed in claim 1, wherein the low sulphur fuel is liquefied natural gas or compressed natural gas.

* * * * *